United States Patent [19]

Sarto

[11] Patent Number: 4,489,489

[45] Date of Patent: Dec. 25, 1984

[54] DISPOSABLE UTILITY BLADE

[76] Inventor: Julius A. Sarto, 773 Pershing St., San Jose, Calif. 95014

[21] Appl. No.: 465,512

[22] Filed: Feb. 10, 1983

[51] Int. Cl.[3] ..... B67B 7/30

[52] U.S. Cl. ..... 30/2; 30/78; 30/346

[58] Field of Search ..... 30/2, 27, 78, 346

[56] References Cited

U.S. PATENT DOCUMENTS

| | | | |
|---|---|---|---|
| 1,534,312 | 4/1925 | Goza | 30/78 |
| 1,553,449 | 9/1925 | Kennedy | 30/2 X |
| 3,803,713 | 4/1974 | Jones et al. | 30/2 X |
| 4,048,719 | 9/1977 | Thompson | 30/2 |

*Primary Examiner*—Frank T. Yost

*Attorney, Agent, or Firm*—Michael L. Harrison

[57] ABSTRACT

An improved utility blade for use with the conventional type of utility knife handle and having means near its cutting points for shielding the cutting points and portions of the cutting edges of the blade from the contents of cardboard cartons.

5 Claims, 5 Drawing Figures

DISPOSABLE UTILITY BLADE

BACKGROUND OF THE INVENTION

This invention relates to utility blades and in particular to a conventional type of utility blade designed to be held by various types of handles.

One type of well known utility implement or knife comprises a generally trapezoidal blade, with its cutting edge on its longest side, and a handle which holds the blade and exposes only a portion of the cutting edge for use. This type of blade is marketed by several companies, including Stanley and Hyde, and is commonly used by retail merchants to open cardboard boxes. For example, during the stocking of grocery store shelves, it is most efficient if the entire top and a portion of the side walls of the cardboard box can be removed so that the packages inside can be quickly taken out and shelved. Because approximately half the cutting edge of the trapezoidal blade is exposed beyond the handle of the conventional utility knife, a substantial portion of the cutting edge often extends into the interior of the box and can result in cutting the packages inside the box. For example, cereal packages are packed inside large cardboard boxes such that the walls of the cereal packages are in direct contact with the inside wall of the cardboard box.

Various attempts have been made by manufacturers of utility blade handles to provide a knife which cuts the cardboard box without damaging the contents. For example, U.S. Pat. No. 3,092,903 to Bockhold and U.S. Pat. No. 4,167,810 to Gilbert both disclose modified handles for holding conventional utility blades such that the blades cut the carton without damaging the contents.

SUMMARY OF THE INVENTION

This invention is an improved utility blade which is capable of being used with conventional utility knife handles and which includes means for protecting the contents of a cardboard carton when the carton is being opened.

In one embodiment the invention comprises a pair of circular disks spaced on opposite faces of the blade near the cutting points at the ends of the cutting edge. The disks are connected to one another through an opening in the blade. The disks extend beyond the cutting points and portions of the cutting edge and their combined thickness is substantially greater than the thickness of the blade.

DESCRIPTION OF THE PREFERRED EMBODIMENT

Figure 1A:
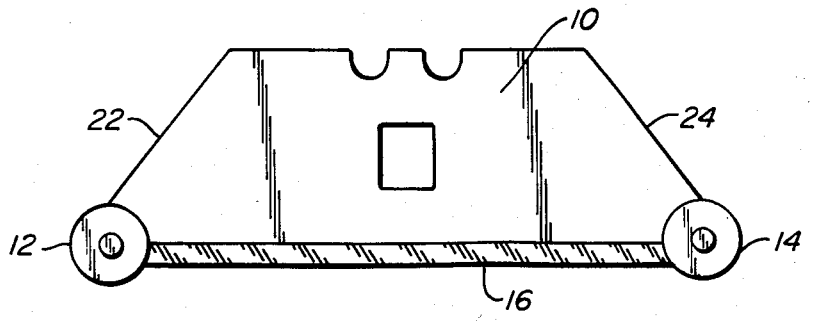
FIG. 1A is a plan view of one embodiment of the improved utility blade.
Figure 1B:
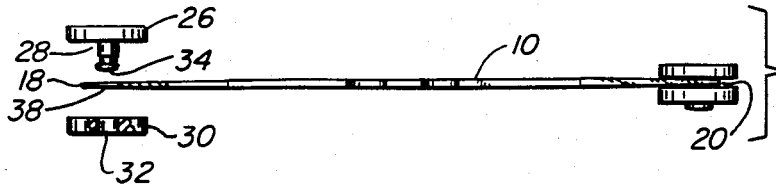
FIG. 1B is a top view of the embodiment shown in FIG. 1A.

The improved utility blade is shown in FIG. 1 as the trapezoidally shaped blade portion 10 with protecting means 12 and 14 at the two corners or cutting points of the blade. The blade portion 10 is a conventional utility blade designed for use with a conventional handle such as those supplied by the Stanley Tool Company. This blade 10 is generally trapezoidally shaped with a cutting edge 16 and cutting points 18, 20 (FIG. 1B) at the acute corners formed by the cutting edge 16 and the two side edges 22, 24.

Referring now to FIG. 1B, the protecting means 12 which is typical of the two protecting means shown in FIG. 1A is shown in a top view with the two portions exploded and separated from the blade 10. The protecting means 12 comprises a first circular disk 26 having a stem 28 connected thereto and a second circular disk 30 with a central opening 32. In the preferred embodiment the disks 26 and 28 are constructed of any plastic material, such as nylon or teflon. As shown, the outer end of stem 28 has an enlarged rim 34 so that the disk 30 may be snapped over it with the outer rim 34 extending beyond the central opening 32 of disk 30. The stem 28 is inserted through an opening 38 which is drilled through the blade 10 and is of slightly less diameter than opening 38 so that the two disks are free to rotate.

It should be apparent that the two disks, when assembled through the opening 38 in blade 10 provide a combined thickness which is substantially greater than that of blade 10. When the two disk portions are so assembled, as shown in FIG. 1, they overlap a portion of the cutting edge 16 and the cutting point 18 of blade 10.

Figure 2A:
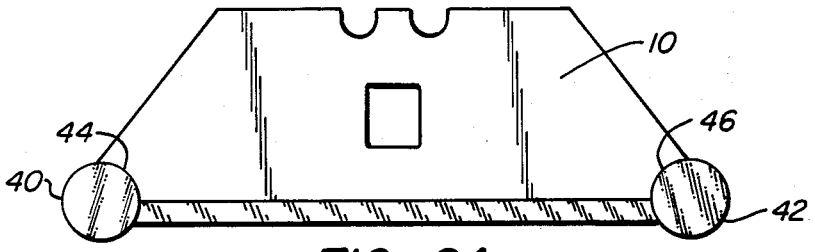
FIG. 2A is a plan view of an alternative embodiment of the improved utility blade.
Figure 2B:
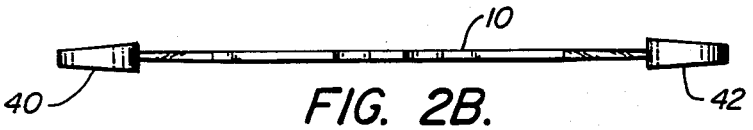
FIG. 2B is a top view of the embodiment shown in FIG. 2A.

FIGS. 2A and 2B illustrate an alternative embodiment of the invention and show enlarged tips 40, 42 permanently bonded to the blade 10 in the region of the cutting points. The side view or profile of the enlarged tips 40, 42 is circular to provide generally rounded surfaces 44, 46 similar to that of the circular disks 26 and 30 of FIG. 1A. The enlarged tips 40, 42 are also preferably constructed of plastic material such as nylon or teflon, and are permanently bonded over the cutting points of the blade 10, either by injection molding the plastic material directly onto the blade, or by the use of a suitable epoxy. In fact, the enlarged tips could be formed of epoxy material and fabricated on the cutting points of the blade by merely dipping the blade into the epoxy material. The tips 40, 42 are tapered to a narrower thichness in the direction outward away from the cutting points of the blade, so that the tips may be more easily inserted through the wall of a cardboard carton.

Figure 3:
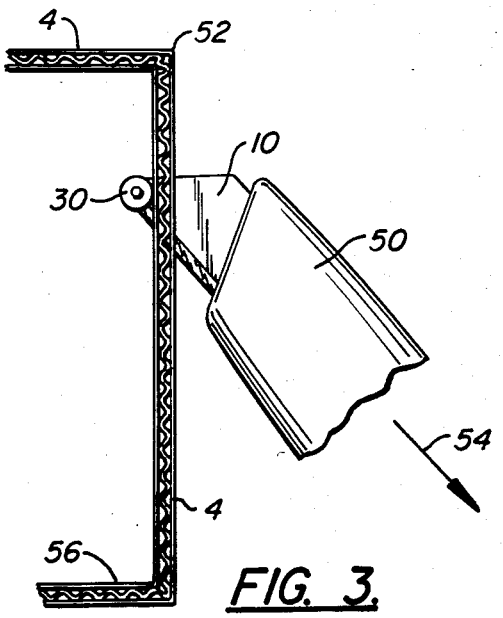
FIG. 3 is a view of the utility blade of FIG. 1A during the process of cutting the wall of a cardboard carton.

The description of the embodiments of the present invention as thus described can be better understood by referring to FIG. 3 which illustrates the embodiment of FIG. 1A during the cutting of a wall 45 of a cardboard carton 47. The blade 10 is held in a conventional type of handle 50, only a portion of which is shown. During the initiation of cutting, the blade 10 is either forced directly through the wall 45 of the carton 47, or the cutting edge 16 can be cut through the corner 52 of the carton with the protecting means forced into the carton interior. During cutting, the handle 50 is pulled outward, in the direction shown by arrow 54, so that the protecting means comprised disks 26, 30, is forced into contact with the inside of wall 45. In this manner, only a slight portion of the cutting edge 16 extends into the carton interior and that portion which does so is protected by the disks. As the blade is pulled through the carton in the direction shown by arrow 54, the cutting edge 16 cuts the wall 44 and the disks, even if they come into contact with the carton interior, do not damage the contents.

Because the protecting means has a thickness, such as that defined by the two disks 26, 30, which is substantially greater than the thickness of the blade, the blade 10 is prevented from passing through the cut made by the cutting edge 16. During cutting the disks are free to rotate against the wall 44 of the carton, although the blade would also function if the disks do not rotate, provided they are constructed of plastic or other material which has little frictional resistance with cardboard. When the blade reaches the end 56 of the wall at the completion of the cut, the protecting means prevents the blade from leaving the carton interior. Thus there is little likelihood of an accident such as occurs with the conventional blade which, when it is quickly released by the cardboard container after the blade reaches the end of the carton wall, often cuts the user.

While the preferred embodiments of the present invention have been illustrated in detail, it should be apparent that modifications and adaptations of those embodiments will occur to those skilled in the art. However, it is to be expressly understood that such modifications and adaptations are within the sphere and scope of the present invention as set forth in the following claims.

What is claimed is:

1. A disposable utility cutting apparatus for opening cartons comprising:

a blade having a generally trapezoidal shape with a cutting edge formed on its longest side and two cutting points at the ends of the cutting edge; and protecting means comprising a pair of generally circular disks spaced on opposite faces of said blade and overlapping the cutting point and the corresponding portion of the cutting edge of said blade, said disks being connected to one another through said blade for protecting the contents of the carton during cutting.

2. The apparatus according to claim 1 wherein said interconnected disks are free to rotate.

3. The apparatus according to claim 1 wherein said protecting means further comprises an enlarged tip permanently bonded to the blade proximate said at least one cutting point, said enlarged tip having a thickness substantially greater than the thickness of said blade.

4. The apparatus according to claim 3 wherein said enlarged tip is tapered convergingly outwardly away from the cutting point, whereby said enlarged tapered tip facilitates entry of the blade through the wall of the carton to be cut.

5. In a disposable utility blade for use in an implement for opening cartons, said blade being of the type having a generally trapezoidal shape with a cutting edge formed on its longest side and cutting points at the ends of said cutting edge, an improvement to the blade comprising protecting means comprising a pair of generally circular disks spaced on opposite faces of said blade and overlapping the cutting point and the corresponding portion of the cutting edge of said blade, said disks being connected to one another through said blade for protecting the contents of the carton during cutting.

* * * * *